United States Patent [19]

Isogawa

[11] Patent Number: 4,969,848

[45] Date of Patent: Nov. 13, 1990

[54] TANK-BUILT-IN OUTBOARD MOTOR

[75] Inventor: Atsushi Isogawa, Hamamatsu, Japan

[73] Assignee: Sanshin Kogyo Kabushiki Kaisha, Hamamatsu, Japan

[21] Appl. No.: 357,471

[22] Filed: May 26, 1989

[30] Foreign Application Priority Data

May 30, 1988 [JP] Japan ..... 63-134567

[51] Int. Cl.[5] ..... B63H 5/12

[52] U.S. Cl. ..... 440/77; 123/196 R; 440/88

[58] Field of Search ..... 440/77, 88; 123/196 R, 123/195 P

[56] References Cited

U.S. PATENT DOCUMENTS

| | | | |
|---|---|---|---|
| 2,935,057 | 5/1960 | Perlewitz | 123/196 R |
| 4,661,076 | 4/1987 | Iwai | 440/77 |
| 4,689,025 | 8/1987 | Ferguson | 440/88 X |

*Primary Examiner*—Sherman Basinger
*Attorney, Agent, or Firm*—Ernest A. Beutler

[57] ABSTRACT

Two embodiments of power head constructions for outboard motors wherein a liquid supply system for the internal combustion engine of the power head is contained within its protective cowling. This liquid supply system includes first and second spaced liquid tanks that are interconnected by a conduit for flow therebetween.

28 Claims, 4 Drawing Sheets

TANK-BUILT-IN OUTBOARD MOTOR

BACKGROUND OF THE INVENTION

This invention relates to a tank built in an outboard motor and more particularly to an improved liquid storage system for the power head of an outboard motor.

As is well known, it is desirable to maintain a compact configuration for an outboard motor and particularly for its power head. However, the increasing displacement and complexity of outboard motors is making this problem more and more difficult. Furthermore, it is frequently the practice to employ some form of liquid storage system in the power head for supplying liquid to the engine for its operation. For example, it has been proposed to employ separate lubricant systems for the outboard motor wherein lubricant is contained within power head and supplied to the engine during its running for lubrication. This type of system is utilized for separate lubrication of two-cycle internal combustion engines as are commonly used in outboard motors.

Although the use of separate lubricating systems have numerous advantages, it is also desirable to insure that the lubricating system has sufficient capability so that the operator need not add lubricant except during infrequent intervals during the engine operation. However, the space problems aforenoted with outboard motors has made it difficult to provide the amount of lubricant capacity within the power head as may be desired.

It is, therefore, a principal object of this invention to provide an improved tank and liquid storage system for an outboard motor.

It is a further object of this invention to provide a compact, high volume liquid storage system for containment within the protective cowling of the power head of an outboard motor.

As is also well known, outboard motors are normally supported for pivotal movement about a horizontally disposed pivot axis for tilt and trim adjustment. Occasionally, the engine may be operated when the outboard motor is tilted up to an extreme position and it is also desirable that the liquid tank be positioned so that the liquid will be supplied to the engine for running even when the outboard motor is tilted up. Generally, this necessitates a forward placement for the lubricant tank, however, the layout of the engine does not always permit the use of a large volume tank at the forward portion of the power head.

It is, therefore, a further object of this invention to provide an improved liquid storage system for the power head of an outboard motor wherein the liquid can be supplied to the engine even when it is tilted up.

SUMMARY OF THE INVENTION

This invention is adapted to be embodied in an outboard motor having a power head comprised of an internal combustion engine and a protective cowling that encircles at least in part the internal combustion engine. In accordance with the invention, a liquid supply system for the engine is contained within the protective cowling and comprises a first liquid tank located at a first area within the protective cowling and adapted to contain a first volume of fluid for the engine and a second liquid tank located at a second area within the protective cowling spaced from the first area and adapted to contain a second volume of the fluid for the engine. Means are provided for communicating the first and second tanks with each other and for communicating the tanks with the engine so as to supply liquid to the engine.

DETAILED DESCRIPTION OF THE PREFERRED EMBODIMENTS

Figure 1:
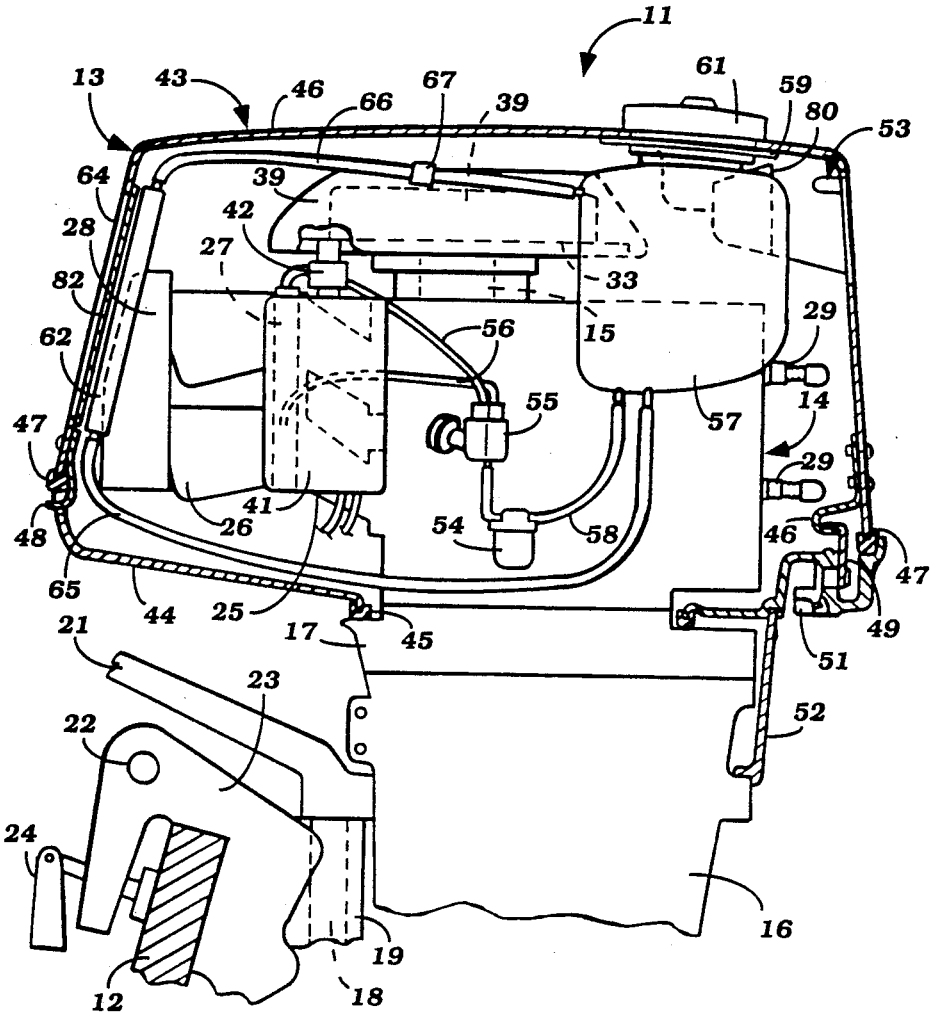
FIG. 1 is a partial side elevational view of an outboard motor as attached to the transom of an associated watercraft, with a portion broken away and other portions shown in section, in accordance with a first embodiment of the invention.
Figure 2:
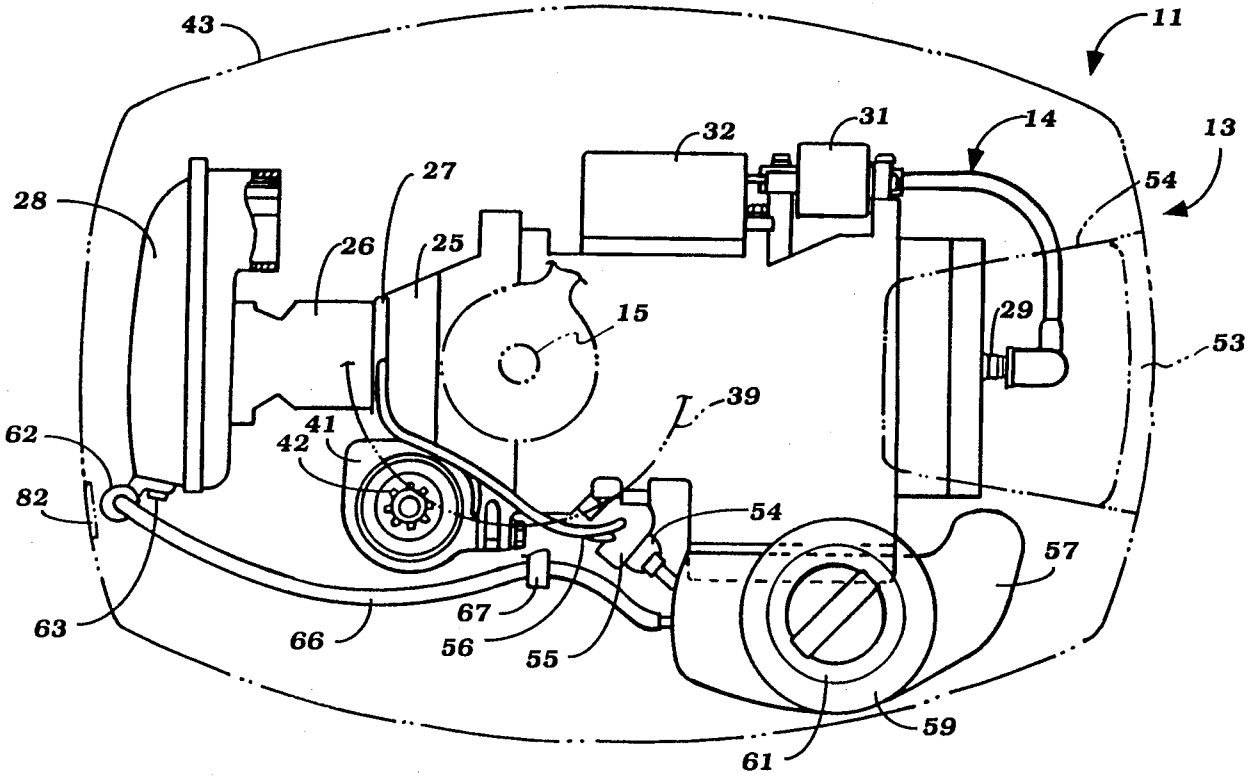
FIG. 2 is a top plan view of the outboard motor shown in FIG. 1, with the protective cowling shown in phantom.

Referring first to the embodiment of FIGS. 1 and 2, an outboard motor constructed in accordance with this embodiment is identified generally by the reference numeral 11 and is shown as attached to a transom 12 of an associated watercraft. The outboard motor 11 is only shown partially since the invention deals primarily with the construction and layout of the components within the power head, indicated generally by the reference numeral 13. These components include an internal combustion engine 14 which may be of any known type and which is, in the illustrated embodiment, depicted as being of the two cylinder, inline type. The engine 14 also operates on the two-stroke cycle, crankcase compression principle but it is to be understood that the invention may be practiced in conjunction with engines having other cylinder number and configurations or, for that matter, other than reciprocating engines. In addition, the invention has particular utility with two-cycle engines employing separate lubricating systems, but certain facets of the invention can be utilized in conjunction with engines operating on the four-stroke principle.

The engine 14 is supported with its output shaft 15 rotating about a generally vertically extending axis, as is well known in the outboard motor art. This output shaft 15 is coupled to a drive shaft (not shown) that is journaled within a drive shaft housing 16 that depends from the power head 13 and which is connected thereto by means of a spacer plate 17 fixed to the upper end of the drive shaft housing 16 and supporting the engine 14. This drive shaft extends through the drive shaft housing and drives a propulsion device such as a propeller in the lower unit. However, since this construction is conventional, it has not been illustrated and description of it is not believed to be necessary to understand the construction and operation of the invention.

A steering shaft 18 is connected to the drive shaft housing 16 in a known manner and is supported for pivotal movement within a swivel bracket 19 for steering of the outboard motor 11 in a known manner. A tiller 21 is affixed to the upper end of the steering shaft 18 for this steering operation.

The swivel bracket 19 is pivotally connected by means of a horizontally extending pivot pin 22 to a clamping bracket 23. This pivotal connection 22 permits tilt and trim of the outboard motor 11 also in a known manner. A clamping device 24 is carried by the clamping bracket 23 for clamping the outboard motor 11 to the transom 12 of the associated watercraft.

Referring now additionally to the construction of the power head 13 and continuing to refer to FIGS. 1 and 2, the engine 14 is provided with an induction system for supplying a fuel/air charge to the crankcase chambers of the engine. This induction system includes an intake manifold 25 that discharges into the individual crankcase chambers through reed type check valves (not shown) in a conventional manner. A pair of carburetors 26, one for each cylinder of the engine, are supported on the manifold 25 with an interposed spacer plate 27 that serves as an arrangement for introducing lubricant to the engine, in a manner to be described. An air intake device such as an air silencer 28 is affixed across the carburetor air horns for silencing and delivering air to the carburetors 26.

The charge which is delivered to the engine combustion chambers through their crankcase chambers and through the associated scavenge passages is fired by means of spark plugs 29 that are supported within the cylinder head of the engine 14. The spark plugs 29 each have associated with them respective spark coils 31 that are fired by an ignition system including a spark control box 32 and flywheel magneto 33. The flywheel magneto 33 is contained within a protective cowling 39.

The flywheel magneto also carries a starter gear that is operatively engaged with an electric starter motor 41 disposed on one side of the engine. The starter motor 41 drives a pinion gear 42 that is engaged with the flywheel starter gear for starting of the engine in a known manner.

The power head 13 further includes a protective cowling assembly, indicated generally by the reference numeral 43 which encircles and encloses the internal combustion engine 14. The protective cowling assembly 43 is comprised of a lower tray portion 44 that is supported upon the spacer plate 17 with an interposed sealing gasket 45. A main cover piece 46 which has a generally inverted cup shape carries a seal 47 at its lower end and is supported upon the tray 44. A fixed latching element 48 carried by the forward portion of the main cover element 46 cooperates with the tray 44 to retain this portion in position. A keeper 49 carried at the rear end of the main cover portion 46 is engaged by a releasable latch mechanism 51 of the tray 44 so as to secure the main cover 46 to the tray 44.

A skirt type flange 52 may extend between the tray 44 and the drive shaft housing 16 so as to provide further concealment and a neat appearance.

The main cover portion 46 is provided with a rearwardly formed indented portion that defines a combined air inlet opening 53 and handgrip so as admit atmospheric air to the engine through an upstanding air inlet 80 for the engine induction system and to afford means whereby an operator may grasp the outboard motor 11 and tilt it up. The air inlet 80 is covered by a portion 81 of the main cover portion so that foreign objects cannot fall into the air inlet 80 and also so as to provide the aforenoted hand grip.

The construction as thus far described is conventional and, for that reason, further details of the conventional components are not believed to be necessary to understand the construction and operation of the invention, which will now be described.

In accordance with the invention, the outboard motor 11 and specifically the engine 14 is provided with a separate lubricating system that includes a filter 54 that receives lubricant from a lubricant supply, to be described, and delivers it to a lubricant pump 55. The lubricant pump 55 discharges through conduits 56 into the spacer plate 27 for delivery of lubricant to the engine through its induction system.

The invention deals with this lubricant supply system that provides a very large capacity for lubricant within the small confines defined within the interior of the protective cowling 43 around the engine 14 and in areas wherein servicing is not obstructed.

This lubricant supply system includes a first lubricant storage tank 57 that is mounted at one side of the engine in proximity to the cylinder head and spark plugs 29. The tank 57 has a generally L-configuration in top plan view and extends for a substantial vertical height. As a result, the tank 57 will provide a relatively large capacity and lubricant is delivered to the filter 54 from the tank 57 through a gravity feed conduit 58.

The tank 57 has a neck portion 59 that extends through the main cowling piece 46 and which is closed by a removable closure cap 61 so that lubricant can be replenished into the system.

In addition to the tank 57, the lubricant system further includes a second tank 62 that is mounted to the front left side of the engine and which, in this illustrated embodiment, is supported from the engine air inlet device 28 by means of a bracket and fastener 63. Preferably, the second tank 62 or a portion of it is either transparent or translucent and a transparent window 82 is supported across an adjacent recess 64 in the main cowling portion 46 so that the amount of lubricant in the system may be readily viewed by an operator. Of course, suitable graduations can be provided either on the window 82, on the adjacent portion of the cowling 44 or on the second tank 62 so as to permit the operator to judge the quantity of lubricant within the system.

The tanks 62 and 57 are interconnected by means of a first lower interconnecting conduit 65 that is suitably connected to fittings at the lower ends of these two tanks and by an upper conduit 66 that is also connected to suitable fittings in these tanks. The upper conduit 66 is primarily a vent conduit and is held in place by means of a bracket 67 that is affixed to the flywheel cover 39 although under some conditions fluid may also flow through this conduit. Liquid is primarily transferred, however, between the tanks 57 and 62 by the lower conduit 65. Also, when the tank 57 is filled, the lubricant will fill the tank 62 due to the interconnecting conduitry and the tank 62 will be vented through the vent of the tank 57 by means of the conduit 67.

The main tank 57 may, rather than being positioned at the rear of the cowling 43 be positioned at the front of the cowling either beside the carburetors 26 or opposite to the tank 62. Such a forward positioning for the main tank will make it easier to add lubricant to the system even during cruising operation.

Figure 3:
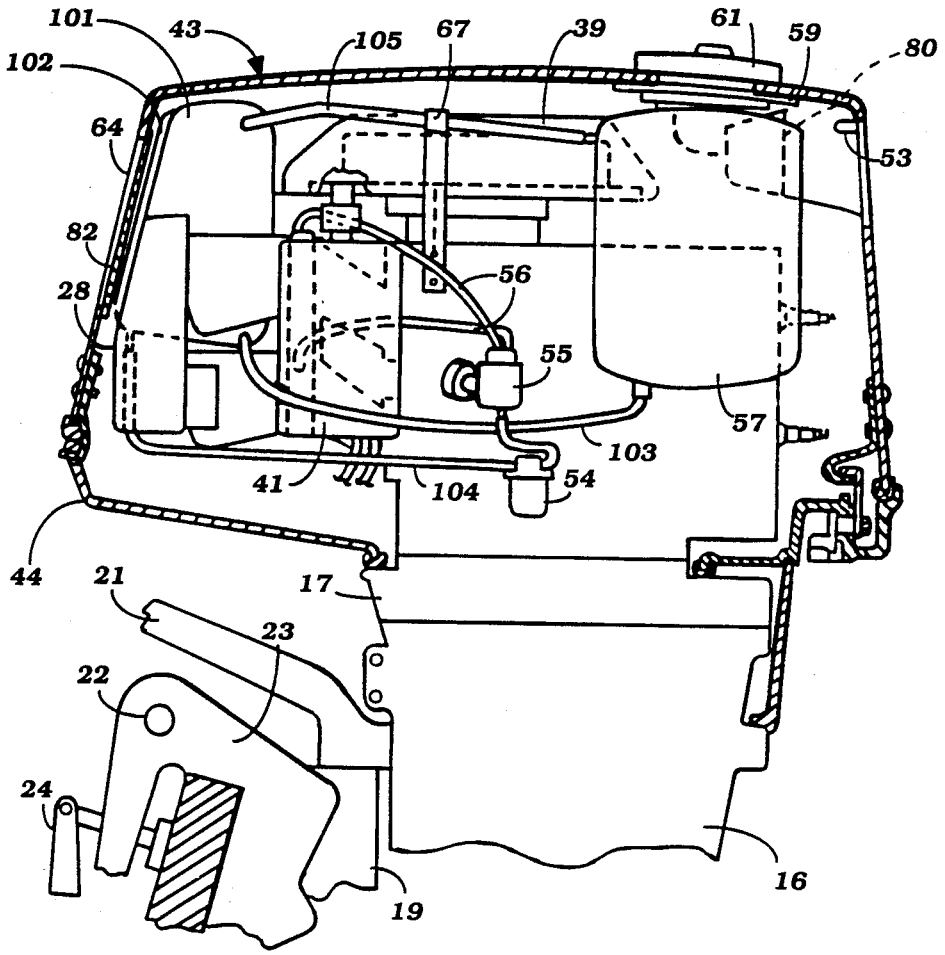
FIG. 3 is a side elevational view, in part similar to FIG. 1 and with portions broken away and shown in section, of a second embodiment of the invention.
Figure 4:
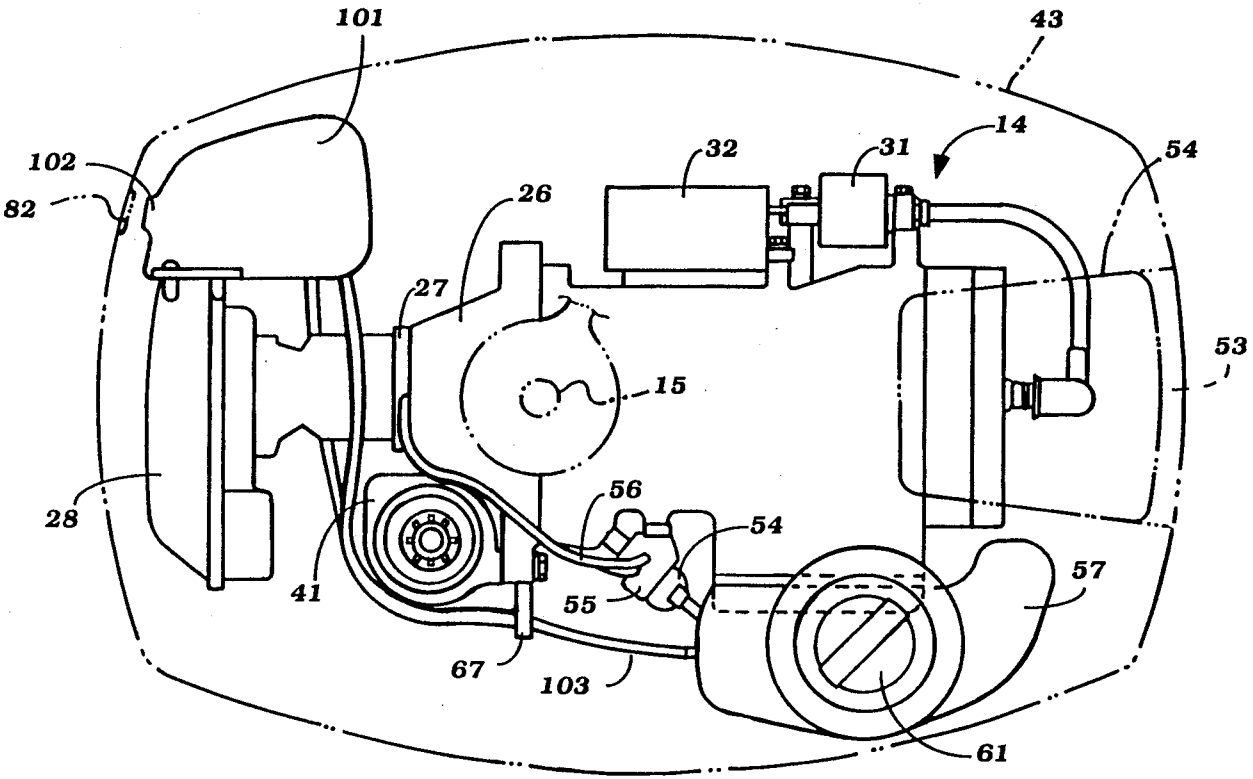
FIG. 4 is a top plan view of this second embodiment with the protective cowling shown in phantom.

FIGS. 3 and 4 show another embodiment of the invention which is basically the same as the embodiment of FIGS. 1 and 2. This embodiment differs from the previously described embodiment only in the location and size of the second lubricant tank and the manner in which lubricant is delivered from the lubricant supply system to the filter 54. Because of this similarity, those components which are the same as those of the previously described embodiment in either function or construction have been identified by the same reference numerals and will not be described again in detail, except insofar as is necessary to understand the construction and operation of this embodiment.

Referring now specifically to this embodiment, a second lubricant tank 101 is supported at the front right side of the protective cowling 43 in an area wherein there are no other major components. The tank 101 has a substantially greater volume because of this placement and is provided with a transparent protrusion 102 that is juxtaposed to the transparent window 63 of the main cover piece 46 for viewing purposes as aforenoted. The fill cap 61 is still for the main or first lubricant tank 57 and this tank is coupled to the tank 101 through a first conduit 103 which extends at the bottom of these tanks. However, in this embodiment, lubricant does not flow directly from the tank 57 to the filter 54 but rather flows from the tank 101 to the filter 54 through a conduit 104. Because of this, when the outboard motor 11 is tilted up, even though the liquid may flow from the tank 57, and depleted, there will always be lubricant for the engine supplied from the tank 101.

Like the previously described embodiment, there is also a vent conduit 105 that extends between the two tanks 57 and 101 at their upper ends.

The tank 101 may alternatively be positioned at the rear of the cowling 43 on the side of the engine 14 opposite to the tank 57. Alternatively, the tank 57 could be repositioned to the front of the cowling 43 on the side opposite from the illustrated position of the tank 101. Also, in all embodiments, fill caps can be added to the supplemental tanks 62 and/or 101, if desired.

It should be readily apparent that the two described embodiments permits the use of a very large capacity for liquid within the power head of an outboard motor. Although the embodiments deal with lubricant tanks, it is to be understood that the invention may also be practiced in combination with fuel tanks or any other tanks containing liquid required by the engine for its operation. In addition to the described and illustrated embodiments, various other changes and modifications may be made without departing from the spirit and scope of the invention, as defined by the appended claims.

I claim:

1. In an outboard motor having a power head comprised of an internal combustion engine, and a protective cowling enclosing at least in part said internal combustion engine, the improvement comprising a liquid supply system for said engine and contained within said protective cowling comprising a first liquid tank located at a first area within said protective cowling and adapted to contain a first volume of fluid for said engine, a second liquid tank located at a second area within said protective cowling and adapted to contain a second volume of fluid for the engine, means communicating said first liquid tank with said second liquid tank, and means including filter means spaced from and separate from each of said liquid tanks for communicating said liquid tanks with the engine for delivering filtered fluid to the engine from each of said tanks.

2. In an outboard motor as set forth in claim 1 wherein the means for supplying the fluid from the liquid tanks to the engine comprises a conduit extending only directly from one of the liquid tanks to the engine.

3. In an outboard motor as set forth in claim 2 wherein the outboard motor is supported for tilt and trim movement relative to the associated watercraft.

4. In an outboard motor as set forth in claim 3 wherein the liquid tank that communicates directly with the engine is the forwardmost tank in the protective cowling.

5. In an outboard motor as set forth in claim 4 further including means providing a full opening to the other liquid tank.

6. In an outboard motor as set forth in claim 1 wherein at least one of the liquid tanks has a translucent portion disposed adjacent to a transparent opening in the protective cowling for viewing the liquid level therein.

7. In an outboard motor having a power head comprised of an internal combustion engine, and a protective cowling enclosing at least in part said internal combustion engine, the improvement comprising a liquid supply system for said engine and contained within said protective cowling comprising a first liquid tank located at a first area within said protective cowling and adapted to contain a first volume of fluid for said engine, a second liquid tank located at a second area within said protective cowling and adapted to contain a second volume of fluid for the engine, means communicating said first liquid tank with said second liquid tank comprising a lower conduit interconnecting the lower ends of said tanks and an upper conduit interconnecting the upper ends of said tanks and means for communicating at least one of the said liquid tanks with the engine for delivering the fluid to the engine.

8. In an outboard motor as set forth in claim 7 wherein the means for supplying the fluid from the liquid tanks to the engine comprises a conduit extending only directly from one of the liquid tanks to the engine.

9. In an outboard motor as set forth in claim 8 wherein the outboard motor is supported for tilt and trim movement relative to the associated watercraft.

10. In an outboard motor as set forth in claim 9 wherein the liquid tank that communicates directly with the engine is the forwardmost tank in the protective cowling.

11. In an outboard motor as set forth in claim 10 further including means providing a fill opening to the other liquid tank.

12. In an outboard motor as set forth in claim 11 wherein at least one of the liquid tanks has a translucent portion disposed adjacent to a transparent opening in the protective cowling for viewing the liquid level therein.

13. In an outboard motor as set forth in claim 12 wherein the engine is provided with a lubricating system and the liquid supply system contains lubricant for the engine.

14. In an outboard motor as set forth in claim 1 wherein the engine is provided with a lubricating system and the liquid supply system contains lubricant for the engine.

15. In an outboard motor having a power head comprised of an internal combustion engine having a cylinder block and a crankcase, and a protective cowling enclosing at least in part said internal combustion engine, said protective cowling having a front face and a rear face, the improvement comprising a first liquid tank located within said protective cowling and adapted to contain a first volume of fluid for said engine, said first liquid tank being positioned forwardly of said cylinder block and said crankcase and contiguous to said front face of said protective cowling, a second liquid tank located at an area within said protective cowling spaced from said front face, adjacent said rear face of said protective cowling and on one side of said cylinder block and adapted to contain a second volume of said fluid for the engine, means communicating said first liquid tank with said second liquid tank, and means for communicating at least one of said liquid tanks with the engine for delivering said fluid to the engine.

16. In an outboard motor as set forth in claim 15 wherein the means for supplying the fluid from the liquid tanks to the engine comprises a conduit extending only directly from one of the liquid tanks to the engine.

17. In an outboard motor as set forth in claim 16 wherein the outboard motor is supported for tilt and trim movement relative to the associated watercraft.

18. In an outboard motor as set forth in claim 17 wherein the liquid tank that communicates directly with the engine is the first tank.

19. In an outboard motor as set forth in claim 18 further including means providing a fill opening to the second liquid tank.

20. In an outboard motor as set forth in claim 15 wherein the first liquid tank has a translucent portion disposed adjacent to a transparent opening in the protective cowling for viewing the liquid level therein.

21. In an outboard motor as set forth in claim 15 wherein the means for communicating the tanks with each other comprises a lower conduit interconnecting the lower ends of the tanks and an upper conduit interconnecting the upper ends of the tanks.

22. In an outboard motor as set forth in claim 21 wherein the means for supplying the fluid from the liquid tanks to the engine comprises a conduit extending only directly from one of the liquid tanks to the engine.

23. In an outboard motor as set forth in claim 22 wherein the outboard motor is supported for tilt and trim movement relative to the associated watercraft.

24. In an outboard motor as set forth in claim 23 wherein the liquid tank that communicates directly with the engine is the first tank.

25. In an outboard motor as set forth in claim 24 further including means providing a fill opening to the second liquid tank.

26. In an outboard motor as set forth in claim 25 wherein the first liquid tank has a translucent portion disposed adjacent to a transparent opening in the protective cowling for viewing the liquid level therein.

27. In an outboard motor as set forth in claim 26 wherein the engine is provide with a lubricating system and the liquid supply system contains lubricant for the engine.

28. In an outboard motor as set forth in claim 15 wherein the engine is provided with a lubricating system and the liquid supply system contains lubricant for the engine.

* * * * *